US008375522B2

(12) United States Patent
York et al.

(10) Patent No.: US 8,375,522 B2
(45) Date of Patent: Feb. 19, 2013

(54) STRAP MONITORING SYSTEM

(75) Inventors: Rachel Dunford York, San Diego, CA (US); Steven Alfred Williams, Lantau Island NT (HK)

(73) Assignee: Rondish Co. Ltd., Hong Kong (CN)

( * ) Notice: Subject to any disclaimer, the term of this patent is extended or adjusted under 35 U.S.C. 154(b) by 325 days.

(21) Appl. No.: 12/629,365

(22) Filed: Dec. 2, 2009

(65) Prior Publication Data

US 2010/0162532 A1 Jul. 1, 2010

Related U.S. Application Data

(60) Provisional application No. 61/200,709, filed on Dec. 2, 2008.

(51) Int. Cl.
*G08B 23/00* (2006.01)

(52) U.S. Cl. ..... 24/16 PB; 24/704.1; 40/633; 40/665

(58) Field of Classification Search ..... 24/16 R, 24/16 PB, 265 R, 17 R, 17 A, 17 AP, 30.5 P, 24/704.2; 40/633, 665
See application file for complete search history.

(56) References Cited

U.S. PATENT DOCUMENTS

| | | | | | |
|---|---|---|---|---|---|
| 2,302,341 | A | * | 11/1942 | Nash | 24/479 |
| 3,020,658 | A | * | 2/1962 | Clark | 40/633 |
| 4,233,715 | A | * | 11/1980 | McDermott | 24/704.1 |
| 4,783,917 | A | * | 11/1988 | Smith et al. | 40/633 |
| 5,448,846 | A | * | 9/1995 | Peterson et al. | 40/633 |
| 5,873,188 | A | * | 2/1999 | Gehris | 40/633 |
| 6,212,808 | B1 | * | 4/2001 | Rubel | 40/633 |
| 2005/0262747 | A1 | * | 12/2005 | Ali et al. | 40/633 |

* cited by examiner

*Primary Examiner* — James Brittain
(74) *Attorney, Agent, or Firm* — Fred C. Hernandez; Mintz, Levin, Cohn, Ferris, Glovsky and Popeo, P.C.

(57) ABSTRACT

A disposable plastic snap and strap device is configured to be secured to a patient or object for monitoring the patient or object. The strap includes a disposable through-pin assembly that secures the strap in a closed and locked position to the patient or object. The through pin assembly includes a lock assembly that prevents the strap from being unlocked until a portion of the through pin assembly is cut.

3 Claims, 6 Drawing Sheets

STRAP MONITORING SYSTEM

REFERENCE TO PRIORITY DOCUMENT

This application claims priority of U.S. Provisional Patent Application Ser. No. 61/200,709, filed on Dec. 2, 2008. The disclosure of the Provisional Patent Application is hereby incorporated by reference in its entirety.

BACKGROUND

The present disclosure related to a patient tagging and monitoring system. More particularly, the present disclosure relates to a disposable and reusable strap for monitoring and tagging patients and other individuals.

Many products, such as hospital patient tagging, baby tagging, and high-end retail product tagging, and more, require a sturdy strap which cannot be casually removed. The straps often include an alarm feature that sends out an alarm when the strap is removed. Whether or not the strap has an added alarm feature, the straps can be expensive. Moreover, it can be environmentally and financially desirable to have a strap that can be used several times rather than a single-use strap that must be discarded after use.

One problem with existing monitoring straps is that a typical strap only works one way—it can be closed, but not opened. In order to remove the strap, the strap must be cut. This renders the strap ruined and unusable after a single use. This "one-use" type of strap is wasteful and undesirable. In view of the foregoing, there is a need for an improved monitoring strap.

SUMMARY

Disclosed is an improved disposable plastic snap and strap device. The strap includes a disposable through-pin that secures the strap in a closed and locked position to the patient or object. When the strap is placed on the patient or object, the through-pin on the snap extends through the strap as usual and the snap is closed. If an alarm is incorporated in the strap, the through-pin also closes a switch on the strap and closes a circuit that maintains the alarm in an off state. On one side of the disposable snap is a plastic link to a lower half of the strap. This holds the strap portions together and prevents twisting of the two sections. In addition, there is a locating slot on the strap that holds it in place. When is it time to remove the snap, this is possible by simply cutting the plastic link between the top and bottom snap and twisting the top snap, such as twisting the snap 90 degrees. This causes the snap to release and there is a key hole lock allowing easy release once turned. There is no way to easily remove the disposable snap without a scissors or similar tool and it is secure on the patient or object.

In one aspect, there is disclosed a security strap system, comprising: a elongated strap having a central region, a first tab extending outward from the central region, and a second tab extending outward from the central region opposite the first tab; a through pin assembly, comprising a first region having a keyhole, a second region having a post, and an arm connecting the first region to the second region; wherein the elongated strap is positionable in a looped configuration by fixing the first tab to the second tab and wherein the post of the through pin assembly maintains the strap in the looped configuration by extending through the first tab, second tab, and keyhole, and wherein the post can be removed from the keyhole when the post is in a first orientation and wherein the arm, when un-cut, prevents the post from being moved to the first orientation.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

DETAILED DESCRIPTION

Before the present subject matter is further described, it is to be understood that this subject matter described herein is not limited to particular embodiments described, as such may of course vary. It is also to be understood that the terminology used herein is for the purpose of describing particular embodiments only, and is not intended to be limiting. Unless defined otherwise, all technical terms used herein have the same meaning as commonly understood by one skilled in the art to which this subject matter belongs.

Figure 1A:
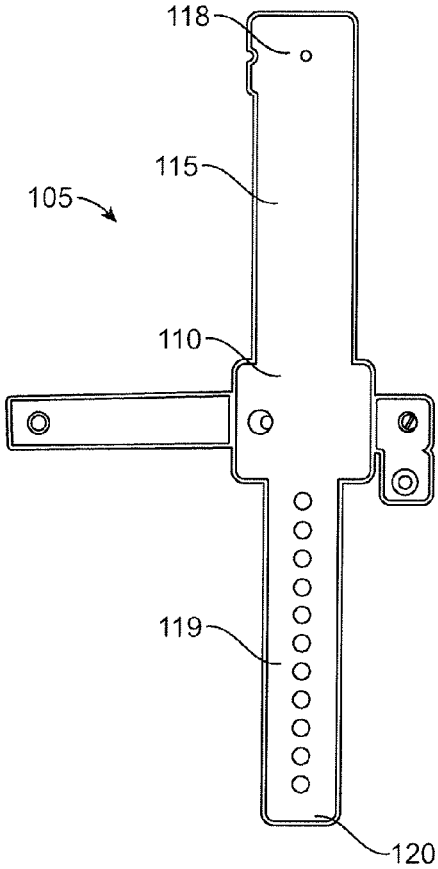
FIGS. 1A and 1B show top and bottom views of a strap that can be secured around the wrist or other body portion of a patient.
Figure 1B:
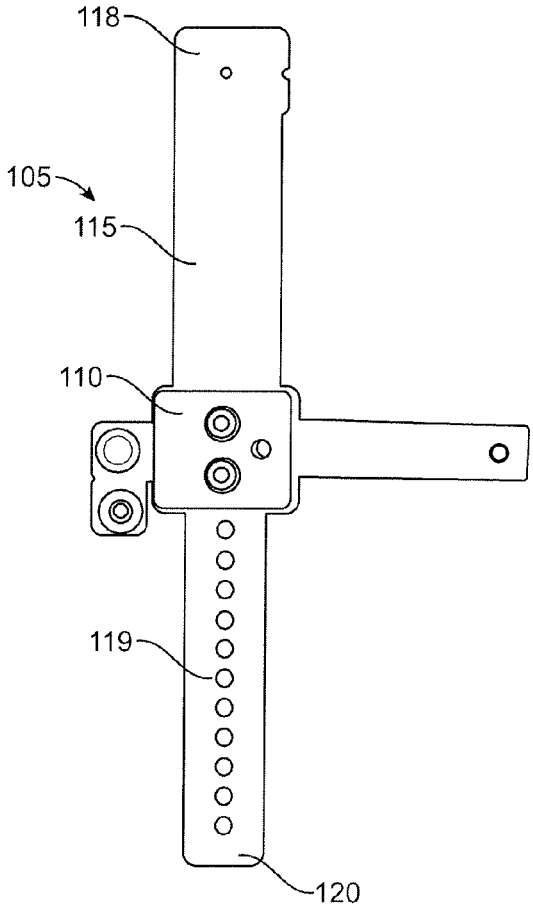

FIGS. 1A and 1B show top and bottom views of a strap 105 that can be secured around the wrist or other body portion of a patient. The strap 105 can also be secured to an object that is to be monitored or tagged, such as an item to be sold. Although described herein in the context of being used to monitor a patient, it should be appreciated that the strap can be used to monitor or tag other individuals (such as babies) or objects.

With reference to FIGS. 1A and 1B, the strap 105 is elongated and includes a central region 110 and two elongated tabs 115 and 120 that extend outwardly from the central region 110. In embodiment, the tabs are sufficiently long such that the strap can be wrapped around the wrist of a person or can be wrapped around something on the patient or object to secure the strap to the patient or object. The tab 115 has one or more holes 118. The tab 120 also has one or more holes 119 that are configured to receive a through-pin (described below) for securing the strap 105 in a closed state or looped state by securing one of the tabs 115 to the other tab 120. In this manner, the strap forms a closed loop around a portion of the patient or object, such as around the patient's wrist. The size and the shape of the strap can be varied.

Figure 2A:
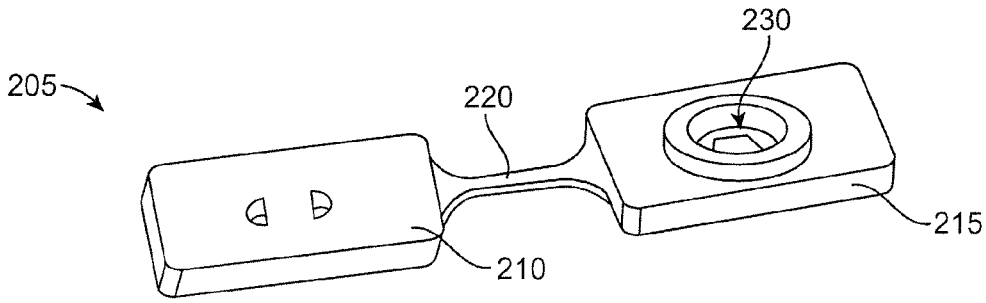
FIGS. 2A and 2B show perspective views of a through-pin assembly of the strap.
Figure 2B:
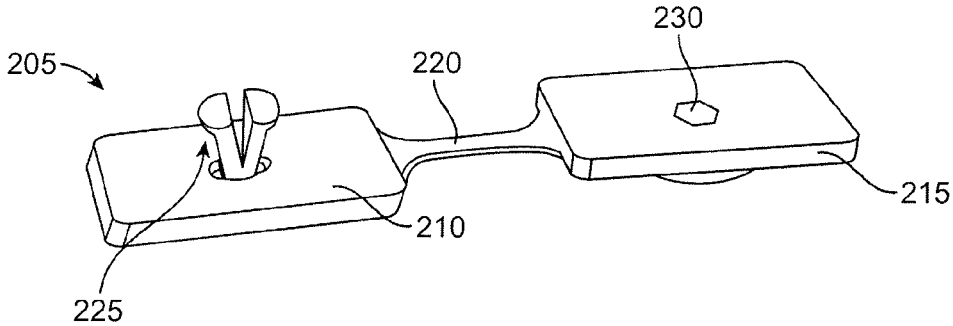

FIGS. 2A and 2B show perspective views of the through-pin assembly 205. The assembly 205 includes a first region 210 and a second region 215 that are interconnected by a flexible arm 220. A post 225 extends outwardly from the first region 210. A keyhole 230 extends through the second region 215. The keyhole 230 is sized and shaped to receive the post 225 therethrough provided the post is positioned in a predetermined orientation. For example, the post 225 may be required to be positioned at a particular angle or orientation relative to the keyhole 230 in order to be inserted therethrough or to be removed therefrom once the post 225 has been inserted through the keyhole 230. In an embodiment, the post 225 must be at a first orientation to be inserted through the keyhole 230. Once the post 225 is inserted through the keyhole 230, the post must be rotated (such as rotated 90 degrees) in order to be removed from the keyhole.

Figure 3A:
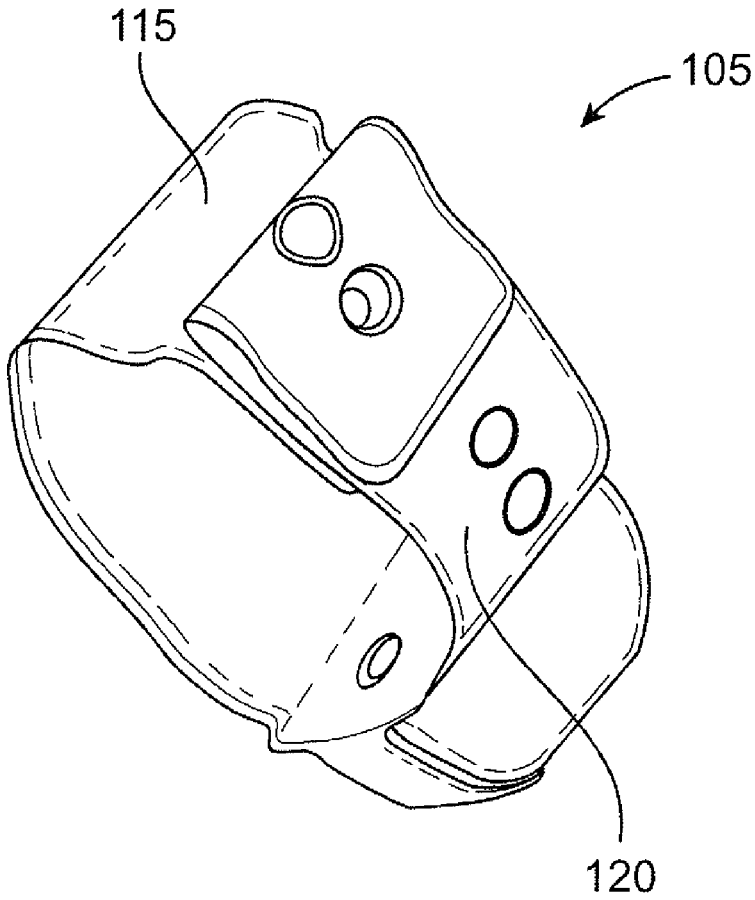
FIGS. 3A through 3C show a method of assembly of the strap.
Figure 3B:
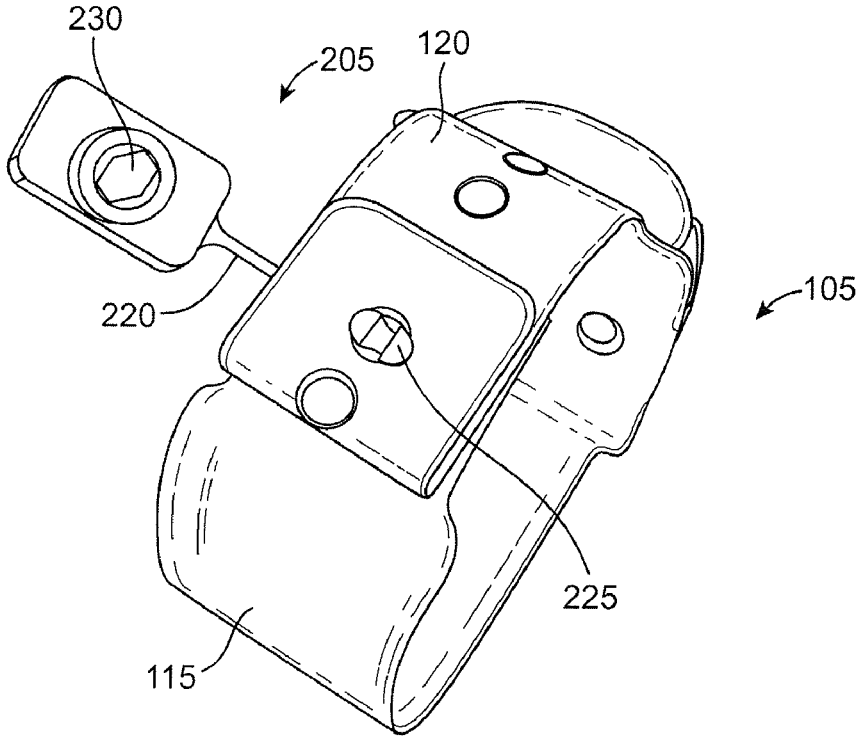
Figure 3C:
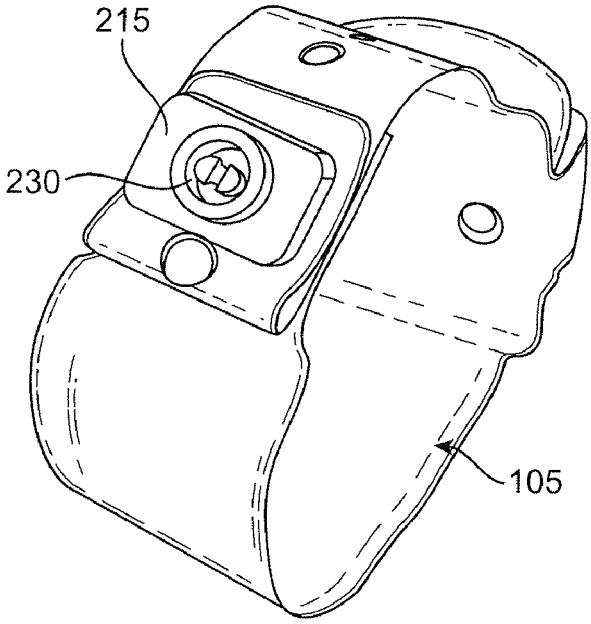

FIGS. 3A-3C illustrate an exemplary method of securing the strap. In use, the strap 105 is placed in a looped configuration such that a hole 118 (FIG. 1A) on the tab 115 is aligned with a hole 119 (FIG. 1A) on the tab 120, as shown in FIG. 3A. If desired, the tab 119 can be folded over itself as shown in FIG. 3A. Next, the through-pin assembly 205 is used to secure and lock the tabs 115 and 120 to one another. With reference to FIG. 3B, through pin assembly 205 is used to secure the tabs 115 and 120 to one another to secure the strap in a looped state.

The post 225 is inserted through the aligned holes 118 and 119 such that the post 225 extends through the holes. Next, the second region 215 is folded over the tabs 115 and 120 such and oriented relative to the post 225 so that the post 225 can be inserted through the keyhole 230. The post 225 is inserted through the hole 230 such that the post 225 locks within the hole 230. In this manner, the through-pin assembly 205 locks the strap 105 in the looped state, as shown in FIG. 3C. When the through-pin assembly 205 is assembled as such, the flexible arm 220 prevents the post 225 from being oriented to a position that would permit the post 225 from being dis-inserted or otherwise removed from the keyhole 230. That is, the arm 220 maintains the post 225 and keyhole 230 in an orientation such that the post 225 cannot be removed from the keyhole 230. In an embodiment, the arm 220 prevents the first region 210 and attached post 225 from being rotated 90 degrees and removed from the keyhole 230.

In an embodiment, the strap and/or the through pin assembly include electronic alarm circuitry. When the post 225 is inserted through the keyhole 230, a switch is closed on the strap, which closes a circuit that maintains the alarm in an off state. The alarm is triggered to an on state if the arm 220 is cut.

Figure 4A:
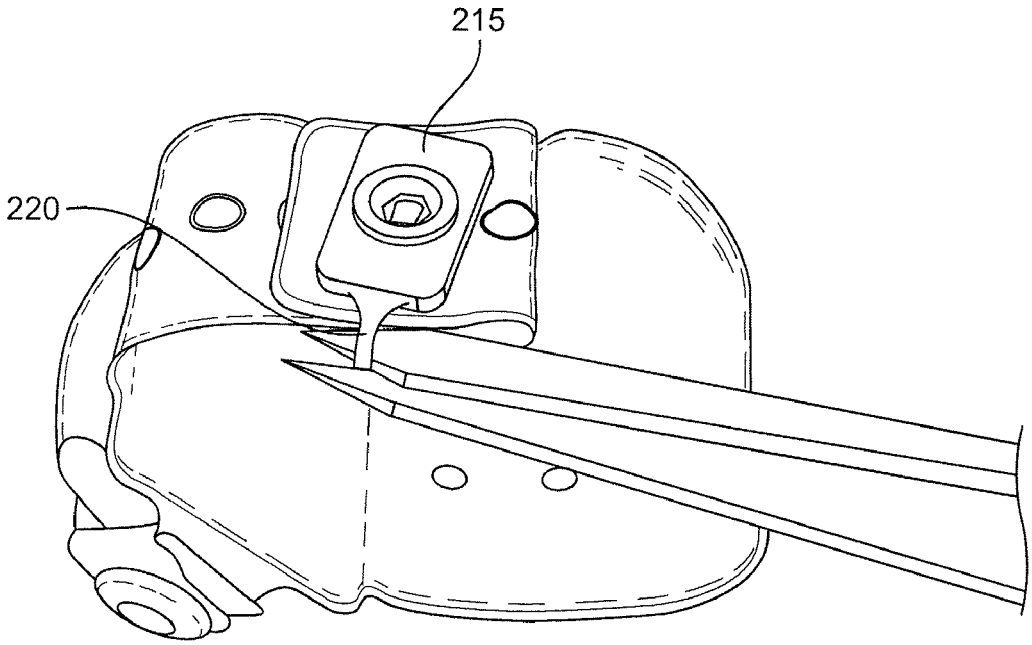
FIGS. 4A through 4C show a method of detaching the strap.
Figure 4B:
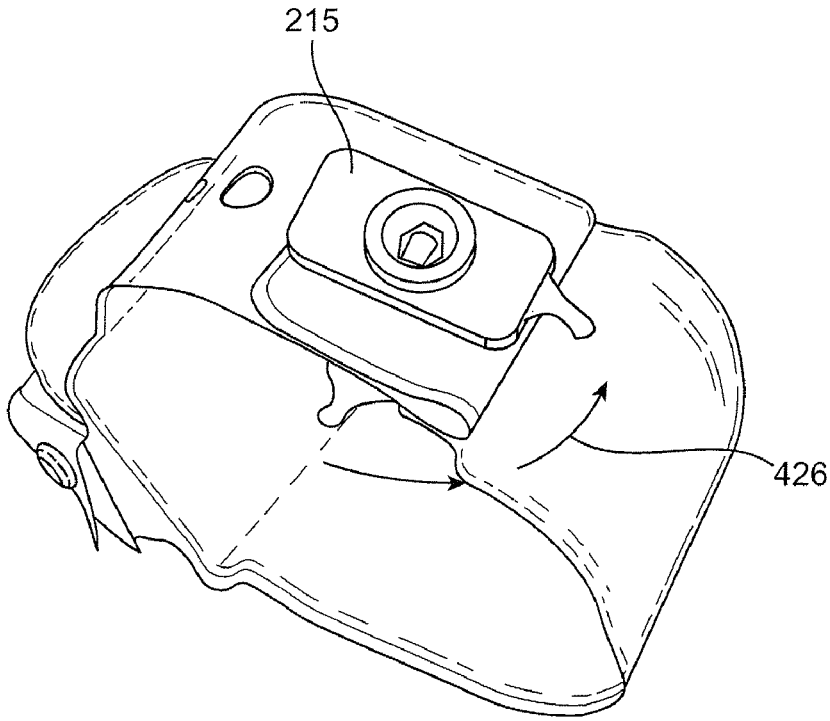
Figure 4C:
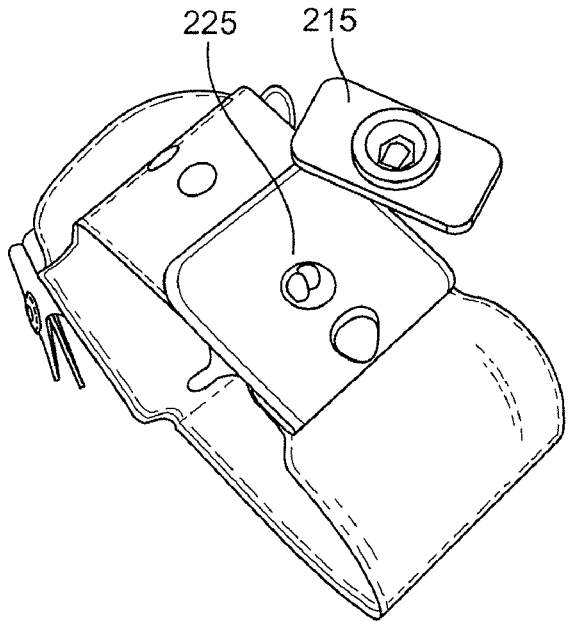

FIGS. 4A-4C show how the strap 105 can be opened and removed from the patient. With reference to FIG. 4A, the flexible arm 220 is cut such as by using a pair of scissors. With the arm 220 cut, the first region 215 is free to be rotated to an orientation that permits the post 225 to be removed from the keyhole 230. When the arm 220 is in place (i.e., un-cut), the arm 220 fixes the first region 215 and post 225 in an orientation that prevents the post from being removed from the keyhole. Thus, once the arm 220 is cut, the post 225 and keyhole 230 may be re-oriented or repositioned to an orientation that permits the post 225 to be removed from the keyhole 230. For example, once the arm 220 is cut, the first region 210 and/or second region 215 can be rotated 90 degrees to the orientation that permits the post 225 to be removed from the keyhole 230, as represented by the arrows 426 shown in FIG. 4B. The through-pin assembly 205 can then be removed from the strap 105, as shown in FIG. 4C.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

Although embodiments of various methods and devices are described herein in detail with reference to certain versions, it should be appreciated that other versions, embodiments, methods of use, and combinations thereof are also possible. Therefore the spirit and scope of the appended claims should not be limited to the description of the embodiments contained herein.

What is claimed:

1. A security strap system, comprising:

a elongated strap having a central region, a first tab extending outward from the central region, and a second tab extending outward from the central region opposite the first tab;

a through pin assembly, comprising a first region having a keyhole, a second region having a post, and an arm connecting the first region to the second region; and an electronic alarm included in the strap system, wherein, when the post of the through pin assembly is inserted through the keyhole, a switch is closed on the strap so as to close a circuit that maintains the alarm in an off state, and wherein the alarm is triggered to an on state if the arm is cut;

wherein the elongated strap is positionable in a looped configuration by fixing the first tab to the second tab and wherein the post of the through pin assembly maintains the strap in the looped configuration by extending through the first tab, second tab, and keyhole, and wherein the post can be removed from the keyhole when the post is in a first orientation and wherein the arm, when un-cut, prevents the post from being moved to the first orientation; and wherein the arm of the through pin assembly forms a curved shape and an opening when the first tab is affixed to the second tab, the opening sized to receive scissors therethrough such that the scissors can cut the arm.

2. A system as in claim 1, wherein the strap is sized to be placed around the wrist of a patient.

3. A system as in claim 1, wherein the post must be rotated 90 degrees in order to be removed from the keyhole and wherein the arm, when un-cut, prevents rotation of the post 90 degrees.

* * * * *